US008989828B2

(12) United States Patent
Nakagawa et al.

(10) Patent No.: US 8,989,828 B2
(45) Date of Patent: Mar. 24, 2015

(54) SUPERCONDUCTING MAGNET APPARATUS

(71) Applicant: Hitachi, Ltd., Tokyo (JP)

(72) Inventors: Ryoji Nakagawa, Hitachi (JP); Ryuya Ando, Hitachi (JP); Manabu Aoki, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 114 days.

(21) Appl. No.: 13/899,673

(22) Filed: May 22, 2013

(65) Prior Publication Data

US 2014/0357491 A1 Dec. 4, 2014

(30) Foreign Application Priority Data

Jun. 4, 2012 (JP) ..... 2012-127568

(51) Int. Cl.
*H01F 6/06* (2006.01)
*H01F 6/04* (2006.01)

(52) U.S. Cl.
CPC ... *H01F 6/06* (2013.01); *H01F 6/04* (2013.01)
USPC ..... 505/163

(58) Field of Classification Search
CPC ..... H01F 6/065; G01R 33/3815
See application file for complete search history.

(56) References Cited

U.S. PATENT DOCUMENTS

| | | | | |
|---|---|---|---|---|
| 4,851,958 | A * | 7/1989 | Takechi | 361/141 |
| 6,646,836 | B2 * | 11/2003 | Yoshikawa | 361/19 |
| 8,780,510 | B2 * | 7/2014 | Huang et al. | 361/19 |
| 2002/0171520 | A1 * | 11/2002 | Yoshikawa | 335/216 |
| 2011/0069418 | A1 * | 3/2011 | Huang et al. | 361/19 |
| 2011/0218111 | A1 * | 9/2011 | Ichiki et al. | 505/163 |

FOREIGN PATENT DOCUMENTS

| | | | |
|---|---|---|---|
| JP | 61-020303 | A | 1/1986 |
| JP | 03-278504 | A | 12/1991 |
| JP | 05-190325 | A | 7/1993 |
| JP | 2768796 | B2 | 4/1998 |

* cited by examiner

*Primary Examiner* — Colleen Dunn
(74) *Attorney, Agent, or Firm* — Mattingly & Malur, P.C.

(57) ABSTRACT

A superconducting magnet apparatus includes: a bobbin around which a superconducting coil is wound, the bobbin serving as a protective resistor; a persistent current switch for supplying a persistent current to the superconducting coil; a first closed circuit with the superconducting coil and the persistent current switch connected in series to the coil; and a second closed circuit with the superconducting coil and the bobbin connected in series to the coil.

20 Claims, 13 Drawing Sheets

SUPERCONDUCTING MAGNET APPARATUS

BACKGROUND OF THE INVENTION

1. Field of the Invention

The present invention relates generally to superconducting magnet apparatuses each equipped with a superconducting coil, and more particularly to protection of a superconducting coil during a quench.

2. Description of the Related Art

Superconducting magnet apparatuses are each equipped with, for example, a superconducting coil, an excitation power supply that supplies current to the superconducting coil, and a persistent current switch that forms a closed circuit for supplying a persistent current. Once a portion of the superconducting coil being energized with the persistent current has suffered a transition into a normal conducting state and developed resistance, the resulting occurrence of joule heat will convert stored magnetic energy into heat energy and increase the temperature of the superconducting coil portion which has transitioned into normal electrical conduction. The periphery of the superconducting coil section which has entered the normal conducting state will also suffer a temperature rise due to heat conduction and make a transition from superconductivity into normal electrical conduction. This transition into normal conduction may eventually extend to the entire superconducting coil in rapid sequence, thus resulting in a so-called quench occurring. When the persistent current is flowing through the superconducting coil and this superconducting coil is holding a large volume of stored magnetic energy, if the large volume of stored magnetic energy is converted into heat energy by the quench, a possible excessive increase in the temperature of the superconducting coil might result in thermal damage to the coil.

Consider a case in which the superconducting coil is a high-temperature superconducting coil constructed of a high-temperature superconductor having a critical temperature exceeding 18 K, such as magnesium diboride ($MgB_2$), iron-based superconductor, or oxide superconductor. The critical temperatures of high-temperature superconductors lie in a region that these superconductors have specific heat capacities at least 10 times as great as those of niobium titanium (NbTi), niobium tin (Nb3Sn), and other low-temperature superconductors having critical temperatures below 18 K. Heat conduction due to a quench causes a delay in the propagation of a normal-conducting region. The quench in a high-temperature superconducting coil, therefore, causes a more significant temperature rise than in low-temperature superconducting coils, since stored magnetic energy is consumed locally.

For this reason, JP-1993-190325-A and other related technical documents propose methods of protecting a superconducting coil. In these methods, a protective resistor that receives a supply of current upon a quench event and consumes stored magnetic energy is provided to suppress the consumption of the stored magnetic energy in the superconducting coil. Since the amount of energy that the protective resistor consumes is proportional to the square of the value of the current flowing through the resistor, applying a higher current to the protective resistor yields a greater suppression effect against the temperature rise due to the quench in the superconducting coil. JP-1991-278504-A and other related technical documents propose methods of supplying a high current to a protective resistor. That is to say, the protective resistor and a persistent current switch are each connected in parallel to and across a superconducting coil so that when a quench occurs, a section of a closed circuit composed of the protective resistor and the persistent current switch, this section not being a closed circuit composed of the protective resistor and the superconducting coil, will be electrically disconnected. By so doing, the current that has been supplied to the persistent current switch can be bypassed and induced into the protective resistor. In addition, when a superconducting magnet apparatus is to be operated on a persistent current, a current lead needs to be disconnected from the internal superconducting circuit of a cryostat for suppressed entry of heat into the cryostat, so a protective resistor cannot be connected to the outside of the cryostat. In this case, therefore, the protective resistor is to be connected to the inside of the cryostat and this connection makes it necessary to provide large enough an installation space inside the cryostat. JP-1986-20303-A and the like, for example, propose methods in which a normal-conducting wire to perform the function of a protective resistor is wound around a superconducting coil in order to save the space required for protective resistor connection.

SUMMARY OF THE INVENTION

To induce a high current into a protective resistor so that stored magnetic energy is consumed therein, a heat capacity large enough to avoid thermal damage due to the induction of the high current needs to be imparted to the protective resistor. To this end, a large installation space needs to be provided for the protective resistor. According to JP-1986-20303-A and the like, since a section for supporting the protective resistor can be imparted to the superconducting coil, an installation space for the support section can be saved and that of the protective resistor can be correspondingly increased. Even so, the installation space for the protective resistor is required and the need to provide a large installation space for the resistor remains to be met. It is considered useful if the installation space for the protective resistor can be reduced while at the same time assigning it the function that consumes the stored magnetic energy without causing thermal damage.

Accordingly an object of the present invention is to provide a superconducting magnet apparatus adapted to consume stored magnetic energy without causing thermal damage to a protective resistor, even if an installation space for the protective resistor is reduced.

In order to solve the foregoing problems, a superconducting magnet apparatus according to an aspect of the present invention includes: a bobbin around which a superconducting coil is wound, the bobbin serving as a protective resistor; a persistent current switch for supplying a persistent current to the superconducting coil; a first closed circuit with the superconducting coil and the persistent current switch connected to each other in series; and a second closed circuit with the superconducting coil and the bobbin connected to each other in series.

In accordance with the present invention, since the protective resistor also serves as the bobbin for the superconducting coil, providing a space for the superconducting coil bobbin makes it unnecessary to provide an independent space for the protective resistor. This means that substantially the space provided for the protective resistor separately from the space for the bobbin can be reduced. In other words, a superconducting magnet apparatus adapted to consume stored magnetic energy without causing thermal damage to a protective resistor, even if an installation space for the protective resistor is reduced, can be supplied in accordance with the present invention. Further objects, configurational aspects, and advantages of the invention will be apparent from the detailed description of embodiments that follows.

BRIEF DESCRIPTION OF THE DRAWINGS

Other objects and advantages of the invention will become apparent from the following description of embodiments with reference to the accompanying drawings in which.

DESCRIPTION OF THE PREFERRED EMBODIMENTS

The following describes embodiments of the present invention in detail referring to the accompanying drawings as appropriate. Elements common to each drawing are each assigned the same reference number or symbol, and overlapped description is omitted herein.

First Embodiment

Configuration of a Superconducting Magnet Apparatus 1

Figure 1:
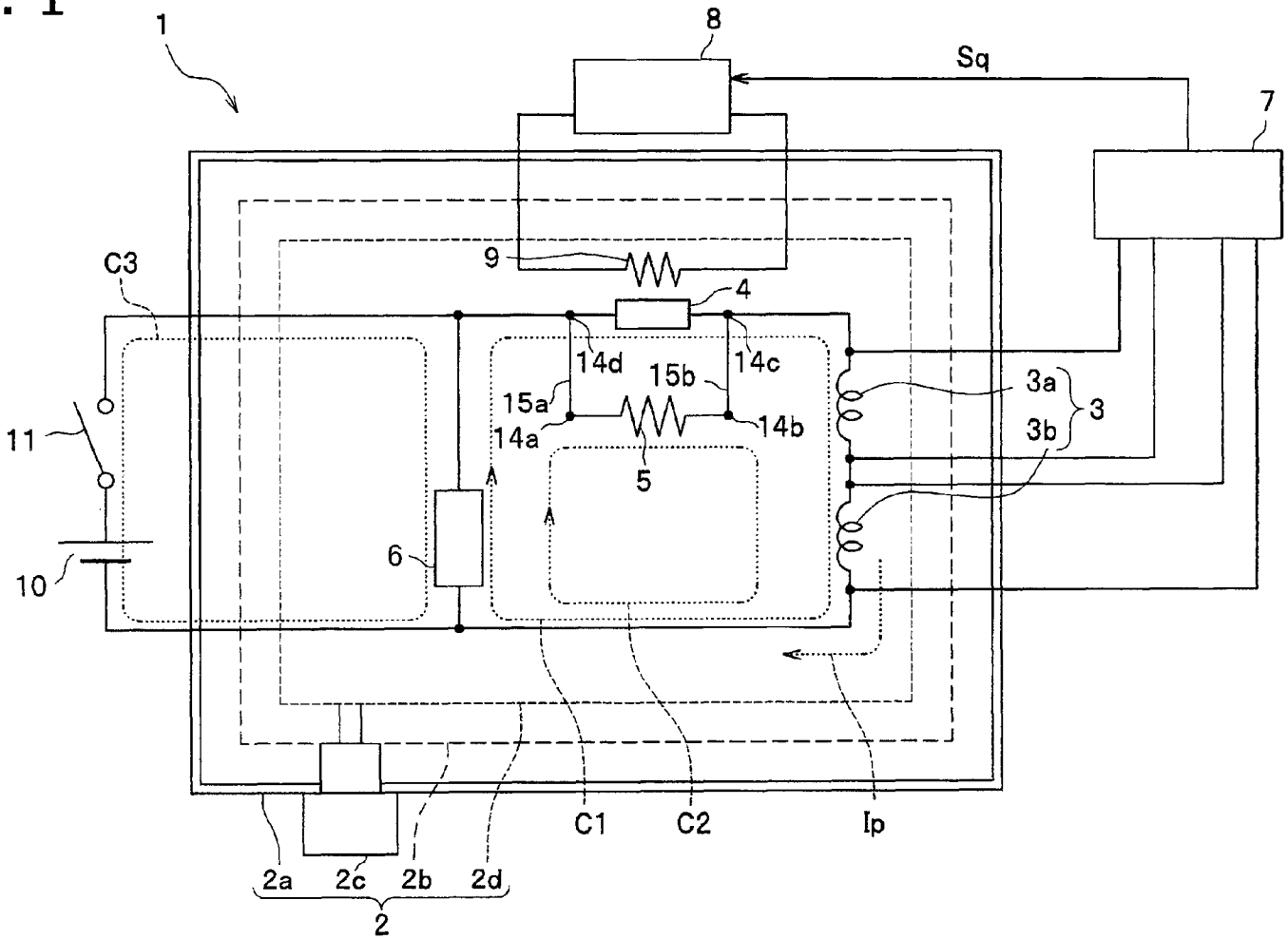
FIG. 1 is a circuit diagram of a superconducting magnet apparatus according to a first embodiment of the present invention.

FIG. 1 shows a circuit diagram of a superconducting magnet apparatus 1 according to a first embodiment of the present invention. The superconducting magnet apparatus 1 includes a superconducting coil 3, a fuse 4, a persistent current switch 6, a bobbin 5 around which a superconducting coil is wound, the bobbin 5 functioning as a protective resistor, a circuit breaker 11, and an excitation power supply 10.

The superconducting coil 3 is provided in singularity or plurality (in an example of FIG. 1, two units). The superconducting coil 3 uses a high-temperature superconductor having a critical temperature exceeding 18 K, such as magnesium diboride ($MgB_2$), iron-based superconductor, or oxide superconductor. The plurality of (in the example of FIG. 1, two) superconducting coils 3 (3*a*, 3*b*) are connected in series. The superconducting coils 3 (3*a*, 3*b*) are each constructed of a superconducting wire wound around the bobbin 5. In each superconducting coil, a peripheral region of one or a plurality of superconducting filaments is shrouded with a cryogenic stabilizer, spatial gaps between the plurality of superconducting filaments are filled in with the cryogenic stabilizer, and the superconducting filaments are bundled together in the cryogenic stabilizer. The superconducting filaments can be, for example, magnesium diboride ($MgB_2$), iron-based superconductors, or oxide superconductors. The cryogenic stabilizer is preferably a material having low electrical resistivity and high thermal conductivity, and can be, for example, silver (Ag), oxygen-free copper (pure copper: Cu), iron (Fe), or the like. The superconducting wire may also be applied to wiring interconnected between the superconducting coil 3, the fuse 4, the persistent current switch 6, and the like.

As with the superconducting coil 3, the persistent current switch 6 uses a high-temperature superconductor having a critical temperature exceeding 18 K. The persistent current switch 6 includes a superconducting wire and a heater. As in the superconducting coil 3, in the superconducting wire, a peripheral region of one or a plurality of superconducting filaments is shrouded with a cryogenic stabilizer, spatial gaps between the plurality of superconducting filaments are filled in with the cryogenic stabilizer, and the superconducting filaments are bundled together in the cryogenic stabilizer. The heater and superconducting wire of the persistent current switch 6 are thermally connected to each other. When the heater generates heat, the heater heats the superconducting wire and thus enables the superconducting wire to make a transition from a superconducting state into a normal conducting state. The transition of the superconducting wire into the normal conducting state opens (turns off) the persistent current switch 6. Conversely, stopping the generation of heat in the heater provides cooling by a heat transfer element 2*d* described later herein, hence allows the superconducting wire to return to the superconducting state, and closes (turns back on) the persistent current switch 6. The cryogenic stabilizer is a metal, such as a copper-nickel alloy or gold-silver alloy, that has higher electrical resistivity than the cryogenic stabilizer (e.g., silver and oxygen-free copper) of the superconducting coils 3 (3*a*, 3*b*). In addition, since heating due to magnetic field fluctuations during a quench is likely to make the persistent current switch 6 suffer a transition into normal conduction, in order to prevent thermal damage to the persistent current switch 6, a resistance value of the protective resistor and a circuit composition are appropriately designed for a sufficient reduction in the amount of energy consumed. The persistent current switch 6, the fuse 4, and the superconducting coils 3*a* and 3*b* are interconnected in series, these elements composing a first closed circuit C1. Turning on the persistent current switch 6 supplies a persistent current Ip to the first closed circuit C1, especially the superconducting coils 3.

As with the superconducting coils 3, the fuse 4 uses a high-temperature superconductor having a critical temperature exceeding 18 K. The fuse 4 includes a superconducting wire. As in the superconducting coils 3, in the superconducting wire, a peripheral region of one or a plurality of superconducting filaments is shrouded with a cryogenic stabilizer, spatial gaps between the plurality of superconducting filaments are filled in with the cryogenic stabilizer, and the superconducting filaments are bundled together in the cryogenic stabilizer. The fuse 4 and the superconducting coils 3*a* and 3*b* are interconnected in series. Connection terminals (connections) 14*c* and 14*d* are provided at the opposite ends of the fuse 4.

The bobbin (protective resistor) 5 uses a non-magnetic material, a normal conducting material (electric conductor), and a member having sufficient strength to operate as one element of the bobbin 5. More specifically, the bobbin (protective resistor) 5 uses a member of aluminum, copper, stainless steel, or the like. The bobbin (protective resistor) 5, the persistent current switch 6, and the superconducting coils 3*a* and 3*b* are interconnected in series, these elements composing a second closed circuit C2. Connection terminals (connections) 14*a* and 14*b* are provided at two places each distant from the bobbin (protective resistor) 5. The connection terminal 14*a* connects to the connection terminal 14*d* of the fuse 4 via a superconducting wire 15*a*. The connection terminal 14*b* connects to the connection terminal 14*c* of the fuse 4 via a superconducting wire 15*b*. Superconducting wires 15*a*, 15*b* may instead be superconductive wiring. The bobbin (protective resistor) 5, the connection terminal 14*a*, the superconducting wire 15*a*, the connection terminal 14*d*, the fuse 4, the connection terminal 14*c*, the superconducting wire 15*b*, and the connection terminal 14*b* also compose a closed circuit independent of the first closed circuit C1 and the second closed circuit C2.

The excitation power supply 10 is a direct-current source for supplying a direct current to each superconducting coil 3. The circuit breaker 11 lets the direct current flow from the excitation power supply 10 into the superconducting coil 3 or interrupts the flow of the direct current. The circuit breaker 11 is connected in series to the excitation power supply 10. The circuit breaker 11, the excitation power supply 10, and the persistent current switch 6 are further interconnected in series, these elements composing a third closed circuit C3. In addition, the circuit breaker 11, the excitation power supply 10, the superconducting coil 3, and the fuse 4 are interconnected in series to compose a further, closed circuit, thus enabling magnetic energy to be stored into the superconducting coil 3. The circuit breaker 11 and the excitation power supply 10 are arranged outside a cryostat 2, and can be removed from a main body of the superconducting magnet apparatus 1.

The superconducting magnet apparatus 1 additionally includes a quench detector 7, heater 9, and a current source (direct-current source) 8. The quench detector 7 detects the normal conducting state that may occur in part of the superconducting coil 3 (3*a*, 3*b*). The quench detector 7 can detect the occurrence of the normal conducting state in part of the superconducting coil 3 (3*a*, 3*b*), as, for example a change in differential potential across the superconducting coil 3 (3*a*, 3*b*). The quench detector 7, upon detecting the occurrence of the normal conducting state in part of the superconducting coil 3 (3*a*, 3*b*), generates an output of a quench detection signal "Sq" and transmits the signal to the current source 8. The current source 8 is a direct-current source, and upon receiving the quench detection signal "Sq", supplies a direct current to a heater 9 to energize this heater.

The heater 9 is thermally connected to the fuse 4. In addition, the heater 9 is preferably in contact with the fuse 4. A flow of the direct current into the heater 9 activates the heater 9 to generate heat, which in turn heats the fuse 4. The fuse 4 then rises in temperature and experiences a transition from superconductivity into normal conduction. When the persistent current Ip through the first closed circuit C1 flows into the fuse 4 which has transitioned into normal conduction, the fuse 4 generates joule heat to heat itself and blow. This opens the first closed circuit C1 and allows the persistent current Ip to continue to flow, with the result that the persistent current Ip flows through the second closed circuit C2 into the bobbin (protective resistor) 5. The bobbin (protective resistor) 5 generates joule heat to heat itself and attenuate the persistent current Ip. When the persistent current Ip is still flowing through the first closed circuit C1, the persistent current switch 6 as well as the fuse 4 may transition into normal conduction. The fuse 4 is desirably designed so that even in this case, a temperature of the fuse 4 will readily increase above that of the persistent current switch 6 to heat the fuse to such an extent that it blows.

The superconducting magnet apparatus 1 further includes a cryostat 2. The cryostat 2 includes a refrigerator 2*c* that cools the superconducting coil 3 and the like by depriving these elements of heat, a heat transfer element 2*d* that conducts heat from the superconducting coil 3 and the like to the refrigerator 2*c*, a vacuum vessel 2*a* that accommodates the heat transfer element 2*d* and the like and conducts heat insulation under a vacuum, and a radiation shield 2*b* that accommodates the heat transfer element 2*d* and the like and suppresses entry of radiant heat. The radiation shield 2*b* is included in the vacuum vessel 2*a*, and the heat transfer element 2*d* is included in the radiation shield 2*b*. The refrigerator 2*c* includes a first stage and a second stage, each of which can be cooled down to a different temperature. The second stage, which is able to be cooled down to a temperature lower than that of the first stage, can be cooled down to a level below a critical temperature of a high-temperature superconductor. The second stage is thermally connected to the heat transfer element 2*d*, and the heat transfer element 2*d* is cooled below the critical temperature of a high-temperature superconductor. The first stage is thermally connected to the radiation shield 2*b*. The first stage cools the radiation shield 2*b*, whereby the radiant heat that the radiation shield 2*b* has absorbed can be released from the first stage.

The heat transfer element 2*d*, thermally connected to the superconducting coil 3 (3*a*, 3*b*), the fuse 4, the persistent current switch 6, and the superconducting wires that connect these elements, transfers (releases) heat to cool them below the critical temperature of a high-temperature superconductor. Thus the superconducting coil 3 (3*a*, 3*b*), the fuse 4, the persistent current switch 6, and the superconducting wires that connect these elements can be maintained in a superconducting condition.

Figure 2A:
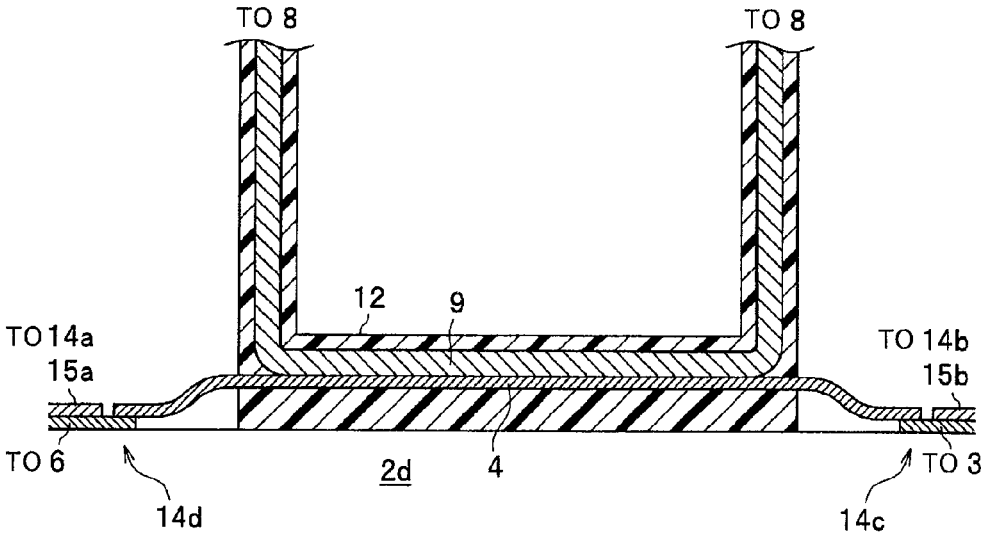
FIG. 2A is a longitudinal sectional view of a fuse and its peripheral members.
Figure 2B:
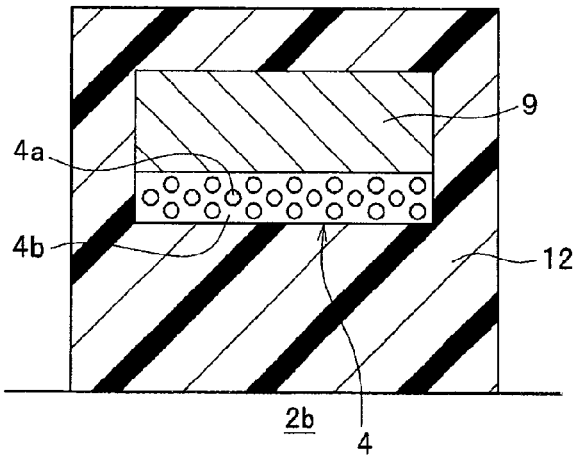
FIG. 2B is a transverse sectional view of the fuse and its peripheral members.

FIG. 2A shows a longitudinal sectional view of the fuse 4 and its peripheral members, and FIG. 2B shows a transverse sectional view thereof. The fuse 4 and its peripheral members in FIG. 2B are shown in more enlarged view than those shown in FIG. 2A. The heater 9 is in contact with the fuse 4, and both are thermally connected to each other. This makes the heater 9 heat the fuse 4 and thus enables it to transition from the superconducting state into the normal conducting state. For ease of heating, the fuse 4 and the heater 9 have their periphery covered with a heat insulator 12 so that the heat generated in the heater 9 will not diffuse to the periphery thereof. The heat insulator 12 can be, for example, an adiabatic material such as a resin, or an adiabatic material having a vacuum structure. The fuse 4 has its connections (terminals) 14*c*, 14*d* connected to the superconducting coil 3 and the persistent current switch 6. The superconducting coil 3 and the persistent current switch 6 are cooled in contact with the heat transfer element 2*s*, and the fuse 4 is cooled via the connections (terminals) 14*c*, 14*d* connecting the superconducting coil 3 and the persistent current switch 6.

The fuse 4, if it blows out, will be replaced with a new fuse 4. This replacement can be easily performed by disconnecting the connections (terminals) 14*c*, 14*d* from the blown fuse 4 and then removing the fuse 4, along with the heater 9 and the heat insulator 12, from the heat transfer element 2*d*. In order to allow for such a blowout, the fuse 4 is placed at a position that enables one to easily access a non-blown fuse, for example at an end of the heat transfer element 2*d*.

The fuse 4 is a so-called superconducting wire, and as shown in FIG. 2B, the periphery of the superconducting filaments 4*a* in the fuse 4 is shrouded with a cryogenic stabilizer 4*b*. The number of superconducting filaments 4*a* is not always limited to two or more and may be one. The plurality of superconducting filaments 4*a* are bundled in the cryogenic stabilizer 4*b*.

Figure 3A:
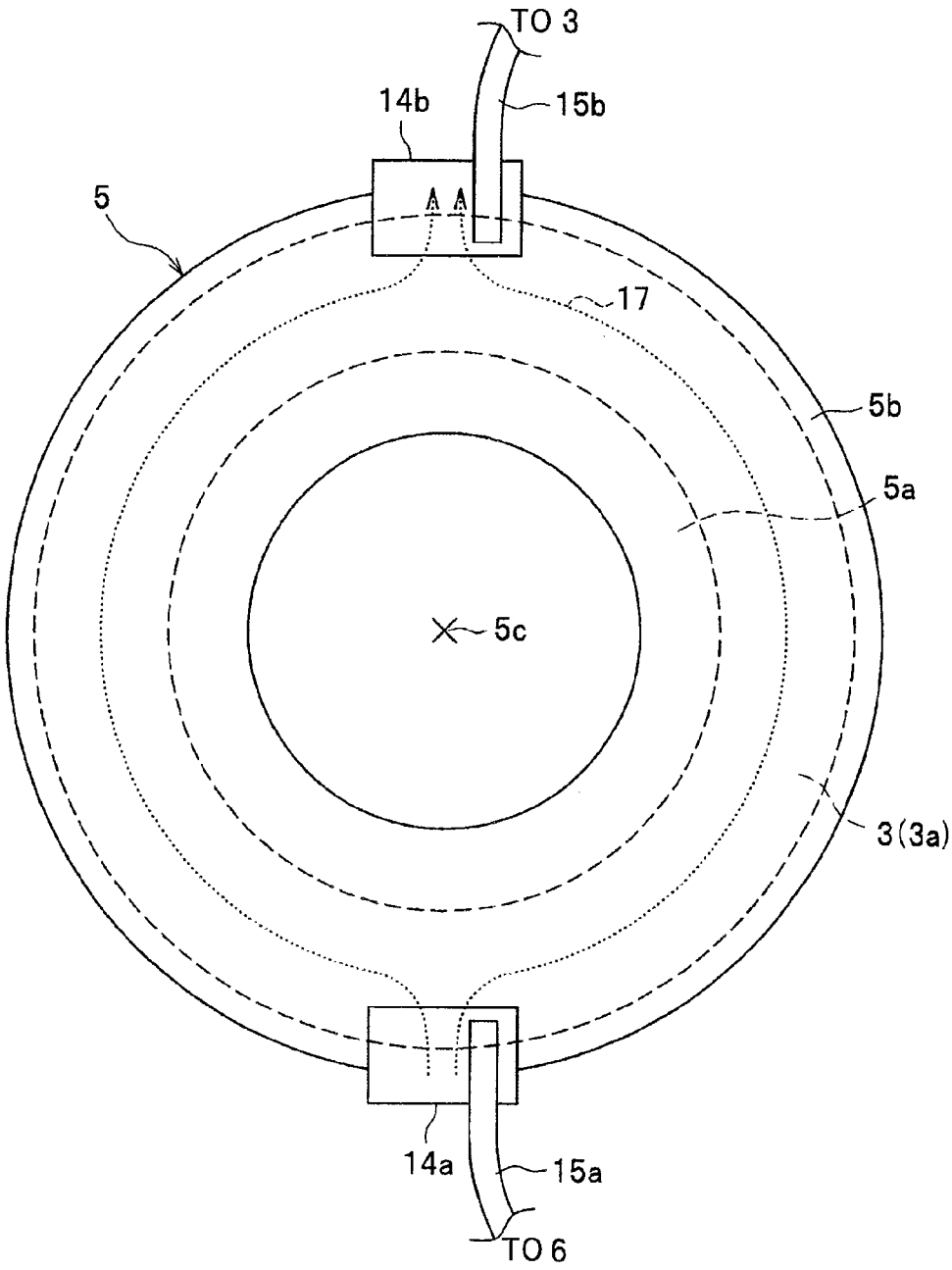
FIG. 3A is a front view of a bobbin for a superconducting coil.
Figure 3B:
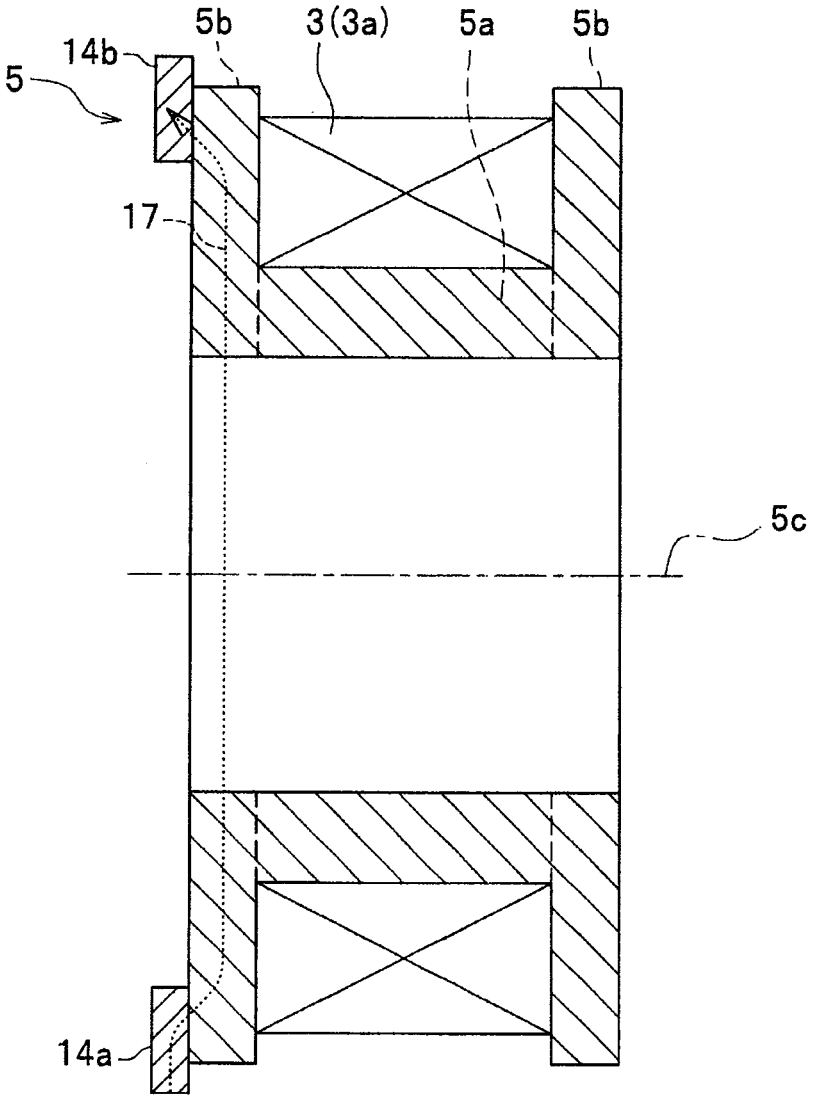
FIG. 3B is a longitudinal sectional view of the superconducting coil and its bobbin.

FIG. 3A is a front view of the bobbin (protective resistor) 5 for the superconducting coil 3 (3*a*), and FIG. 3B is a longitudinal sectional view of the superconducting coil 3 (3*a*) and bobbin (protective resistor) 5 as viewed longitudinally along a plane from a central axis 5*c* of both. Although FIGS. 3A and 3B show the superconducting coil 3*a* by way of example, this coil may be the superconducting coil 3*b* and the bobbin (protective resistor) 5 for both of the superconducting coils 3*a* and 3*a* may also serve as the protective resistor. The bobbin (protective resistor) 5 includes a cylinder 5*a* and one pair of flanges 5*b* extended with the cylinder 5*a* put therebetween. The paired flanges 5*b* are provided at the opposite ends (open ends) of the cylinder 5*a*. The flanges 5*b* have an inside diameter substantially equal to that of the cylinder 5*a*. Outside diameter of the flanges 5*b* is greater than that of the cylinder 5*a*. The superconducting coil 3 (3*a*) is wound around the cylinder 5*a*, between the flanges 5*b*. The superconducting wire material of the superconducting coil 3 (3*a*) wound around the bobbin (protective resistor) 5 is of a type whose surface includes an electrical insulating layer or covered with an electrical insulating sheet. This structure keeps the superconducting wire of the superconducting coil 3 (3*a*) out of electrical contact with the bobbin (protective resistor) 5.

Connection terminals 14*a* and 14*b* are provided at two places that are distant from each other on one of the paired flanges 5*b*. The connection terminals 14*a* and 14*b* are provided on outer circumferential sections of the paired flanges 5*b*. The connection terminals 14*a* and 14*b* are positioned across the central axis 5*c* of the bobbin (protective resistor) 5 (flange 5*b*). The connection terminals 14*a* and 14*b* are positioned at where a line segment (line) connecting the connection terminals 14*a* and 14*b* intersects with the central axis 5*c* of the bobbin (protective resistor) 5 (flange 5*b*). The superconducting wire 15*a* connecting to the persistent current switch 6 and forming a part of the first closed circuit C1 (see FIG. 1) is connected to the connection terminal 14*a*. The superconducting wire 15*b* connecting to the superconducting coil 3 (3*a*) and forming a part of the second closed circuit C2 (see FIG. 1) is connected to the connection terminal 14*b*. Thus, the bobbin (protective resistor) 5 to which the superconducting wires 15*a* and 15*b* connect is also considered to form a part of the second closed circuit C2 (see FIG. 1). During the quench of the superconducting coil 3, the persistent current Ip flows into the bobbin (protective resistor) 5 from the connection terminal 14*a*, and after flowing along a bifurcated flow route 17 of the current, flows out from the connection terminal 14*b*. As the persistent current Ip is flowing through the bobbin (protective resistor) 5, the bobbin (protective resistor) 5 generates joule heat and consumes the energy stored within the superconducting coil 3. The bobbin (protective resistor) 5 thus functions as a protective resistor. The bobbin (protective resistor) 5 is formed to be strong enough to support the superconducting coil 3 (3*a*) upon which a strong electromagnetic force acts by the flow of the persistent current Ip. An installation space wide enough to meet this physical requirement is ensured for the bobbin (protective resistor) 5. At the same time, to flow a large current into the protective resistor so that the stored magnetic energy is consumed therein, it is necessary to impart large enough a heat capacity to the protective resistor so as to prevent its thermal damage due to the inflow of the large current. For this reason, a wide installation space also needs to be provided for the protective resistor. The bobbin (protective resistor) 5 also functions as the protective resistor. This means that a sufficient installation space is also already ensured for the bobbin (protective resistor) 5 as the protective resistor. This, in turn, further means that the heat capacity that is necessary and large enough to prevent the bobbin (protective resistor) 5 from suffering thermal damage during the quench can be assigned. Additionally, when the space for the bobbin 5 of the superconducting coil 3 is provided, a space independent of that space is not needed for the protective resistor, which means that an internal configuration of the cryostat 2 (see FIG. 1) is simplified.

(Operation of the Superconducting Magnet Apparatus 1)

Next, operation of the superconducting magnet apparatus 1 is described below. First, as shown in FIG. 1, the superconducting coils 3 (3*a*, 3*b*), the fuse 4, and the persistent current switch 6 are cooled below the critical temperature of a high-temperature superconductor by heat-conductive cooling with the heat transfer element 2*d*, and thereby maintained in a superconducting state.

Next after the persistent current switch 6 has been opened (turned off) for normal conduction, the circuit breaker 11 is closed (turned on) and the current is supplied from the excitation power supply 10 to the superconducting coils 3 (3*a*, 3*b*). After this, the persistent current switch 6 is closed (turned on) for superconductivity, the current from the excitation power supply 10 is turned off, and then the circuit breaker 11 is opened (turned off). At this time, although the supply of the current from the excitation power supply 10 to the superconducting coils 3 (3*a*, 3*b*) is stopped, current attenuation in the first closed circuit C1 having the superconducting coils 3 (3*a*, 3*b*), fuse 4, and closed (activated) persistent current switch 6 connected in series, becomes very small, which then resumes the flow of the persistent current Ip and places the superconducting magnet apparatus 1 in persistent-current operation. During persistent-current operation, the superconducting magnet apparatus 1 can form/hold the magnetic fields over extended periods of time, even without power being supplied from the excitation power supply 10. Since the bobbin (protective resistor) 5 has finite electrical resistance, substantially no current flows into the bobbin (protective resistor) 5 (second closed circuit C2) during persistent-current operation.

A description is given below of a case in which, during the persistent-current operation of the superconducting magnet apparatus 1, part of the superconducting coil 3*a* of the two superconducting coils 3 (3*a*, 3*b*) undergoes a transition into the normal conducting state and this normal conduction expands to the peripheral region of that part, that is, the quench event occurs. First, if a normal-conduction transition occurs in part of the superconducting coil 3*a*, the quench detector 7, upon determining that for example, the differential potential across the superconducting coil 3*a* has exceeded a predetermined value, detects the partial normal-conduction transition of the superconducting coil 3*a* and transmits the quench detection signal "Sq" to the direct-current power supply 8. After receiving the quench detection signal "Sq", the direct-current power supply 8 supplies the direct current to a heater 13 in contact with the fuse 4. The heater 13 then heats the fuse 4, whereby the fuse 4 transitions from the superconducting state into the normal-conducting state and generates joule heat in itself to blow. The cryogenic stabilizer 4*b* (see FIG. 2B) of the fuse 4 is formed from a material higher in electrical resistivity and lower in thermal conductivity than the superconductor cryogenic stabilizer material used in the superconducting coils 3 (3*a*, 3*b*), and the fuse 4 itself is covered with the heat insulator 12 (see FIGS. 2A and 2B). Compared with the normal-conduction transition part of the superconducting coils 3 (3*a*, 3*b*), therefore, that of the fuse 4 is large in the amount of heat generated, low in heat diffusion rate, and high in an increase rate of temperature. This means that even if the superconducting coils 3 (3*a*, 3*b*) suffer thermal damage, the fuse 4 can be made to blow out before that.

When the fuse 4 blows, this section exhibits a very high resistance value and the persistent current Ip is rerouted to the bobbin (protective resistor) 5 having a lower resistance value. A consequential flow of a larger persistent current Ip into the bobbin (protective resistor) 5 correspondingly increases the volume of stored magnetic energy consumed, and the generation of heat in the superconducting coils 3 (3*a*, 3*b*) is suppressed, that is, the superconducting coils 3 (3*a*, 3*b*) are lowered in maximum temperature. This avoids thermal damage to the superconducting coils 3 (3*a*, 3*b*). Additionally, since the fuse 4 is placed at a position readily accessible for replacement, the fuse can be replaced after the attenuation of the persistent current Ip, so the superconducting magnet apparatus 1 can be energized once again.

(Operational Effects)

As described above, in accordance with the first embodiment, since the bobbin (protective resistor) 5 of the superconducting coils 3 also serves as a protective resistor, if the space for the bobbin 5 of the superconducting coils 3 is provided, a space independent of that space does not need to be provided for the protective resistor (5). This means that the installation space provided for the protective resistor (5) separately from the space for the bobbin 5 in conventional technology has been reduced. Briefly, in accordance with the embodiment is provided the superconducting magnet apparatus 1 adapted to consume stored magnetic energy without thermally damaging the protective resistor (5), even if the installation space for the protective resistor (5) is reduced.

Second Embodiment

Figure 4:
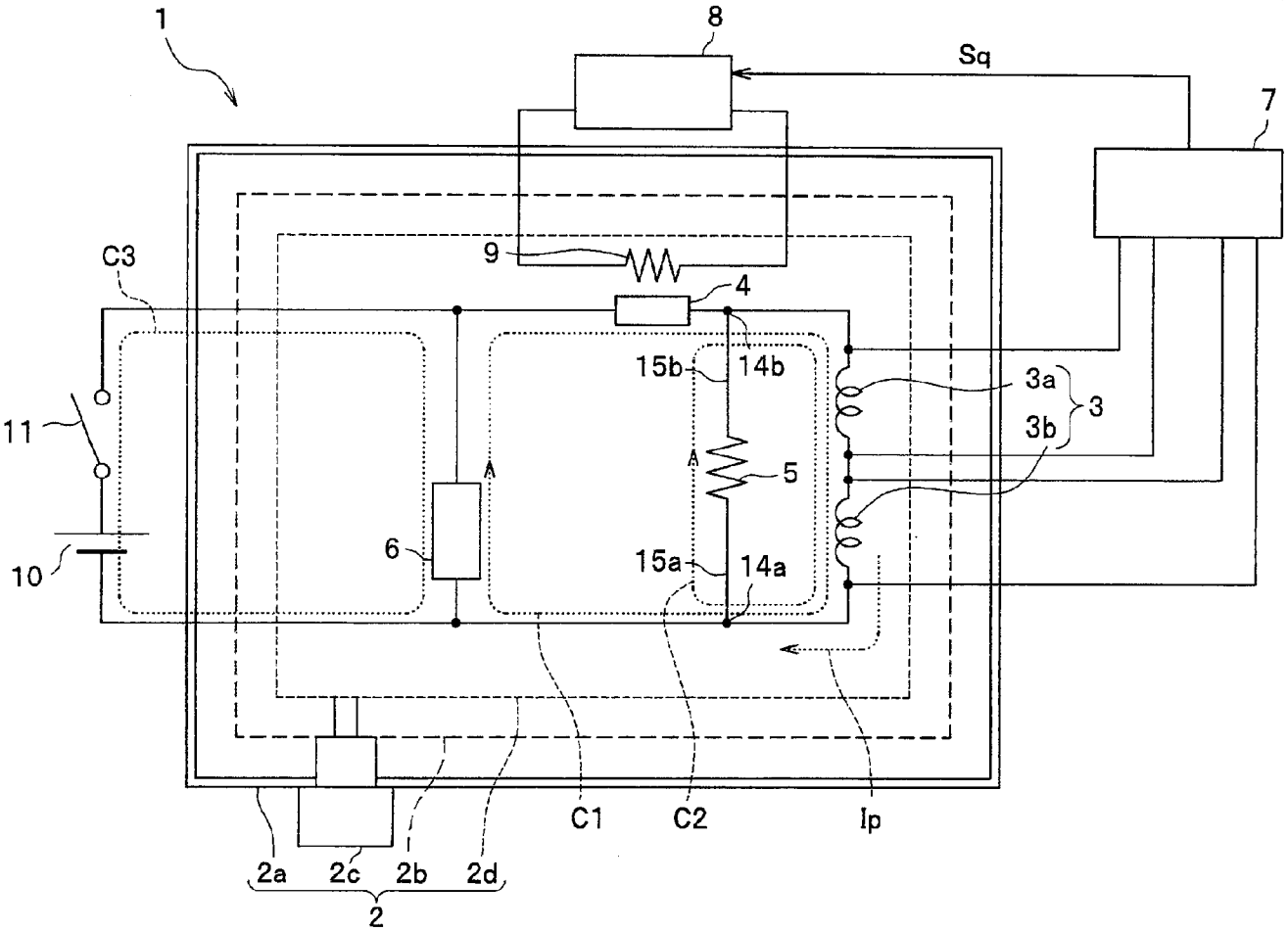
FIG. 4 is a circuit diagram of a superconducting magnet apparatus according to a second embodiment of the present invention.

FIG. 4 shows a circuit diagram of a superconducting magnet apparatus 1 according to a second embodiment of the present invention. The superconducting magnet apparatus 1 of the second embodiment differs from that of the first embodiment in that a second closed circuit C2 is composed substantially by series connection between a bobbin (protective resistor) 5 and superconducting coils 3*a* and 3*b*, and in that a persistent current switch 6 is excluded from the second closed circuit C2. The second embodiment provides substantially the same advantageous effects as those of the first embodiment. Additionally in the second embodiment, once a fuse 4 has blown out, a persistent current Ip does not flow into the persistent current switch 6. Therefore, even if heat due to magnetic field fluctuations during a quench causes the persistent current switch 6 to transition into a normal conducting state, consumption of stored magnetic energy in the persistent current switch 6 is suppressed by the blowout of the fuse 4. By virtue of this protection function, the heat capacity of the persistent current switch 6 that has been needed for the prevention of thermal damage in the first embodiment can be made smaller than in the first embodiment, and an installation space for the persistent current switch 6 can also be reduced.

Third Embodiment

Figure 5:
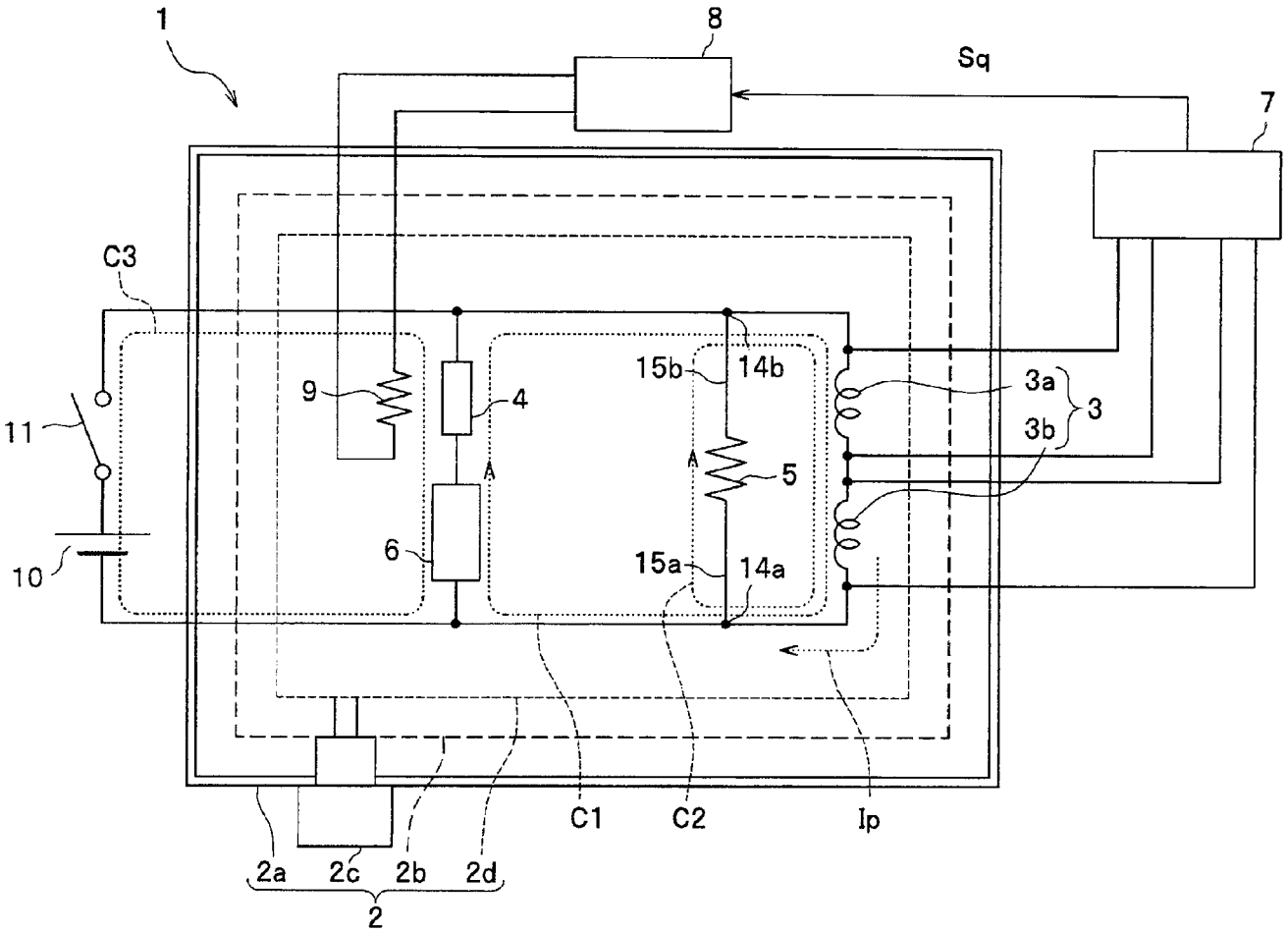
FIG. 5 is a circuit diagram of a superconducting magnet apparatus according to a third embodiment of the present invention.

FIG. 5 shows a circuit diagram of a superconducting magnet apparatus 1 according to a third embodiment of the present invention. The superconducting magnet apparatus 1 of the third embodiment differs from that of the second embodiment in that a third closed circuit C3 is composed substantially by series connection between a persistent current switch 6, a fuse 4, an excitation power supply 10, and a circuit breaker 11, and in that the fuse 4 is added as an element of the third closed circuit C3. Series connection between superconducting coils 3*a* and 3*b*, a bobbin (protective resistor) 5, series connection between the persistent current switch 6 and the fuse 4, and series connection between the excitation power supply 10 and a circuit breaker 11 are each in a parallel connection format. The third embodiment provides substantially the same advantageous effects as those of the first and second embodiments.

Fourth Embodiment

Next, a superconducting magnet apparatus 1 according to a fourth embodiment is described below. The superconducting magnet apparatus 1 according to the fourth embodiment differs from those of the first to third embodiments in that a low-temperature superconductor that exhibits superconductivity at a critical temperature equal to or less than 18 K is used in each of superconducting coils 3, a fuse 4, superconducting filaments in a superconducting wire used in a persistent current switch 6, and superconducting filaments in a superconducting wire interconnecting each of those elements. In association with this difference, a cryostat 2 has appropriate or sufficient cooling capabilities to maintain superconductivity of the low-temperature superconductor. Niobium titanium (NbTi), niobium tin ($Nb_3Sn$), or the like can be used as the low-temperature superconductor having the critical temperature of 18 K or less. The critical temperature of the low-temperature superconductor, compared with the high-temperature superconductors having critical temperatures exceeding 18 K, lies in a region that the low-temperature superconductor has a specific heat capacity at most one-tenth as great as those of niobium titanium (NbTi), niobium tin (Nb3Sn), and other low-temperature superconductors having critical temperatures below 18 K. For this reason, heat conduction due to a quench causes a delay in the propagation of a normal-conducting region. In the superconducting coils 3, therefore, stored magnetic energy can also be consumed without causing thermal damage, so that the stored magnetic energy to be consumed in a protective resistor (5) can be lessened. Hence the installation of a protective resistor for the low-temperature superconductors does not require a space as wide as that required for high-temperature superconducting coils. In the fourth embodiment, however, since a bobbin (protective resistor) 5 for the superconducting coils 3 also serves as a protective resistor, if an appropriate space for the bobbin 5 of the superconducting coils 3 is provided, a space independent of that space does not need to be provided for the protective resistor (5). The installation space for the protective resistor (5) can be made smaller than in the first embodiment, but even so, it follows that the installation space required has been reduced. In addition, even when the installation space for the protective resistor (5) is reduced, the stored magnetic energy can be consumed without thermally damaging the protective resistor (5).

Fifth Embodiment

Figure 6A:
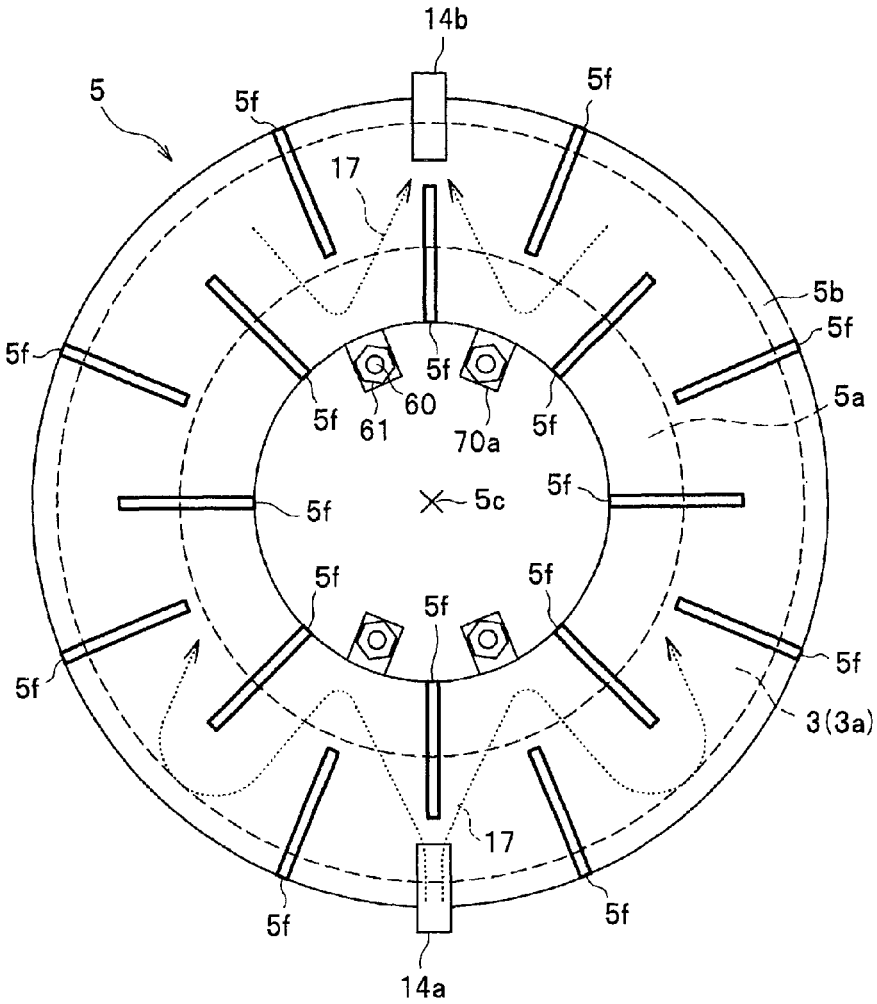
FIG. 6A is a front view of a bobbin for a superconducting coil used in a superconducting magnet apparatus according to a fifth embodiment of the present invention.
Figure 6B:
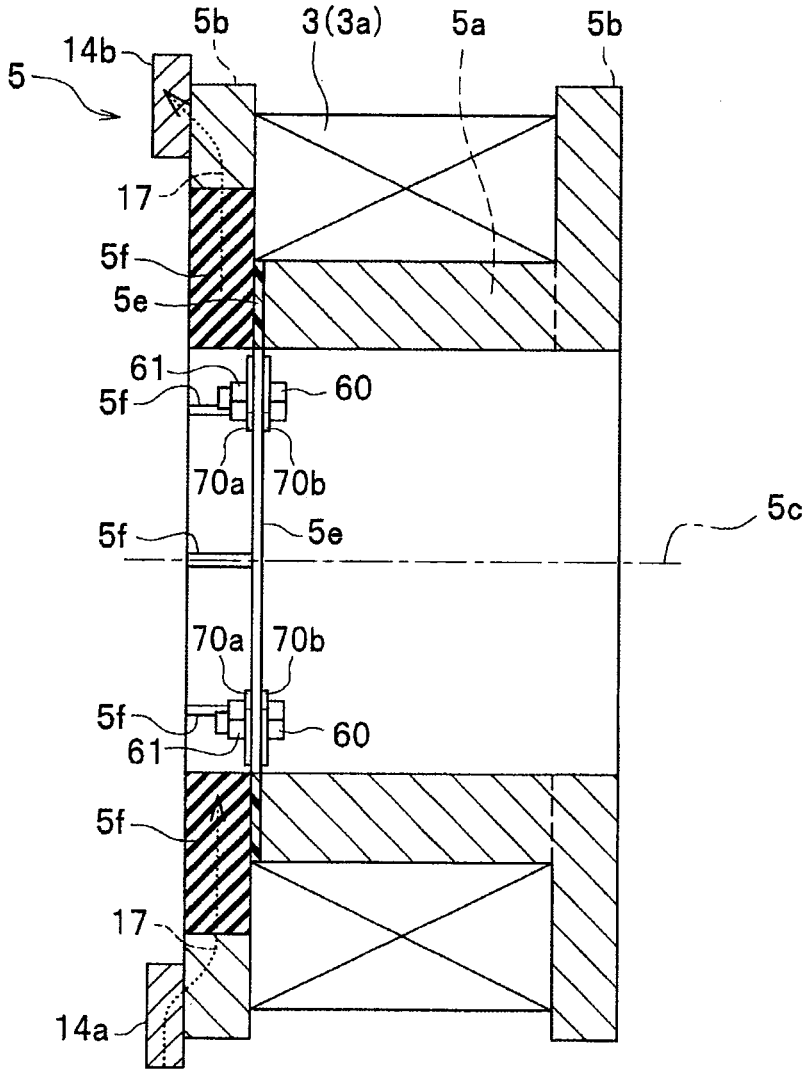
FIG. 6B is a longitudinal sectional view of the superconducting coil and its bobbin used in the superconducting magnet apparatus according to the fifth embodiment of the present invention.

FIG. 6A shows a front view of a bobbin (protective resistor) 5 for a superconducting coil 3 used in a superconducting magnet apparatus according to a fifth embodiment of the present invention, and FIG. 6B shows a longitudinal sectional view of the superconducting coil 3 and its bobbin (protective resistor) 5. The superconducting magnet apparatus 1 according to the fifth embodiment differs from those of the first to fourth embodiments in that the bobbin (protective resistor) 5 includes a cylinder 5*a* and flanges 5*b* electrically insulated from the cylinder 5*a*, and in that a plurality of grooves 5*f* are formed on each flange 5*b*. In the example of FIG. 6A, on the flange 5*b* are formed sixteen grooves 5*f* in all, eight reaching an inner edge of the flange 5*b* and eight reaching an outer edge thereof. The grooves 5*f* are carved downward from an upper surface of the flange 5*b* through to a lower surface thereof. While an insulator is buried in the grooves 5*f*, nothing may be buried therein. The grooves 5*f* are provided in a radial form extending outward from a central portion of the bobbin (protective resistor) 5 (flange 5*b*). One end of each groove 5*f* reaches either the inner edge or outer edge of the flange 5*b*. One of any two adjacent grooves 5*f* reaches the inner edge of the flange 5*b*, and the other of the two adjacent grooves 5*f* reaches the outer edge of the flange 5*b*. This layout of the grooves 5*f* staggers a current-flow route 17 directed from a connection terminal 14*a*, towards a connection terminal 14*b*, and thus increases a resistance value of the bobbin (protective resistor) 5 relative to that obtained in the first embodiment. The flange 5*b* and the cylinder 5*a* are fastened together at fastening portions 70*a* by bolts 60 and nuts 61.

As shown in FIG. 6B, the flange 5*b* and the cylinder 5*a* are isolated from each other by an insulating member (insulating sheet) 5*e*. The insulating member (insulating sheet) Se is positioned between the flange 5*b* and the cylinder 5*a*. The flange 5*b* and the cylinder 5*a* are electrically insulated from each other. The fastening portions 70*a* are provided on the flange 5*b*. Fastening portions 70*b* are provided on the cylinder 5*a*. Fastening with the fastening portions 70*a* and 70*b* is accomplished by tightening a bolt 60 and a nut 61.

Figure 7A:
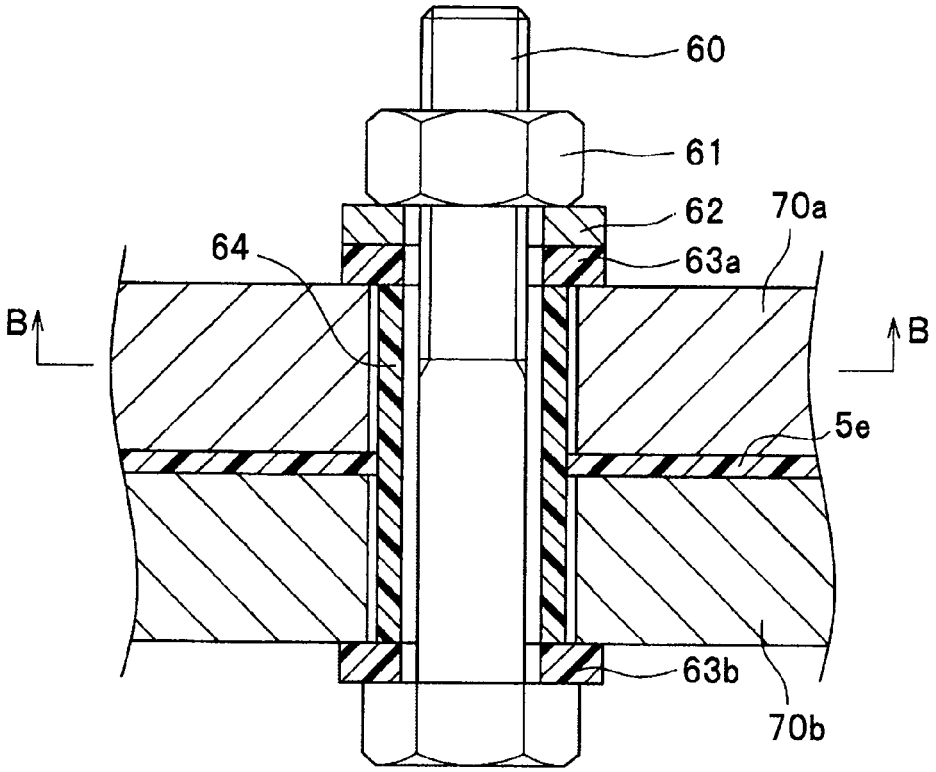
FIG. 7A is a longitudinal sectional view of fastening portions and peripheral members thereof.
Figure 7B:
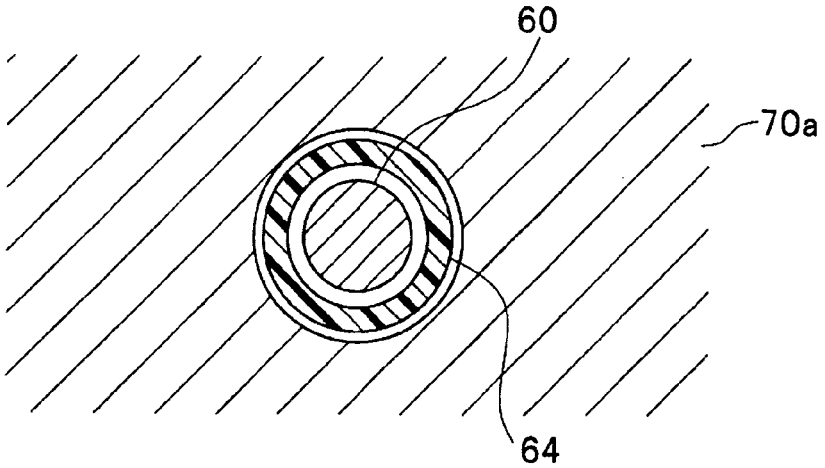
FIG. 7B is a transverse sectional view of a fastening portion and peripheral members existing when seen from a direction of line B-B in FIG. 7A.

FIG. 7A shows a longitudinal sectional view of fastening portions 70*a* and 70*b* and peripheral members thereof, and FIG. 7B shows a transverse sectional view of one fastening portion and peripheral members existing when seen from a direction of line B-B in FIG. 7A. The insulating sheet 5*e* is positioned between the fastening portion 70*a* and the fastening portion 70*b*. A through-hole is formed in each of the fastening portion 70*a*, the fastening portion 70*b*, and the insulating sheet 5*e*. An insulating collar 64 of a cylindrical shape extends through the through-hole penetrating the fastening portion 70*a*, the fastening portion 70*b*, and the insulating sheet 5*e*. Insulating washers 63*a* and 63*b* are provided at the opposite ends of the insulating collar 64. The insulating washers 63*a* and 63*b* have an outside diameter greater than a diameter of the through-hole extending through the fastening portions 70*a* and 70*b*. The bolt 60 extends through the insulating collar 64 and the insulating washers 63*a* and 63*b*. A spring-lock washer 62 is set on the bolt 60 and then the nut 61 is threadably engaged with the spring-lock washer 62 to obtain secure fastening with the fastening portions 70*a* and 70*b*. The bolt 60, the nut 61, and the spring-lock washer 62 are each formed of a material, for example stainless steel, that has sufficient mechanical strength required for fastening. The bolt 60, the nut 61, and the spring-lock washer 62 are not in direct contact with the fastening portions 70*a* and 70*b*, and are in close proximity thereto via the insulating collar 64 and the insulating washers 63*a* and 63*b*, so the fastening portions 70*a* and 70*b* do not come into electrical connection. In addition, since the insulating sheet 5*e* is positioned between the fastening portions 70*a* and 70*b*, these fastening portions can be electrically insulated from each other to provide firm fastening. This in turn enables electrical insulation of the flange 5*b* and cylinder 5*a* shown in FIG. 6B. Since the connection terminals 14*a* and 14*b* are provided on the flange 5*b* insulated from the cylinder 5*a*, although the current-flow route 17 directed from the connection terminal 14*a* towards the connection terminal 14*b* might go through the flange 5*b*, the current-flow route 17 is limited in itself so as not to go through the cylinder 5*a*. The resistance value of the bobbin (protective resistor) 5 is therefore increased relative to that obtained in the first embodiment.

As described above, since the current-flow route 17 is limited to the inside of the flange 5*b* by the presence of the insulating sheet 5*e* and is staggered within the flange 5*b* by the presence of the grooves 5*f*, the resistance value of the bobbin (protective resistor) 5 is high relative to that obtained in the first embodiment. A time required for the current attenuation during the quench is correspondingly reduced. A time required for the quench detector 7 to detect the quench in the superconducting coil 3, and a time required until the fuse 4 has been blown out are extended according to the particular reduction in the quench detection time required. Consequently, the quench detector 7, the fuse 4, and other members and system elements required for the circuit composition are simplified, for example, the capacity of the heater 13 is reduced.

Sixth Embodiment

Figure 8A:
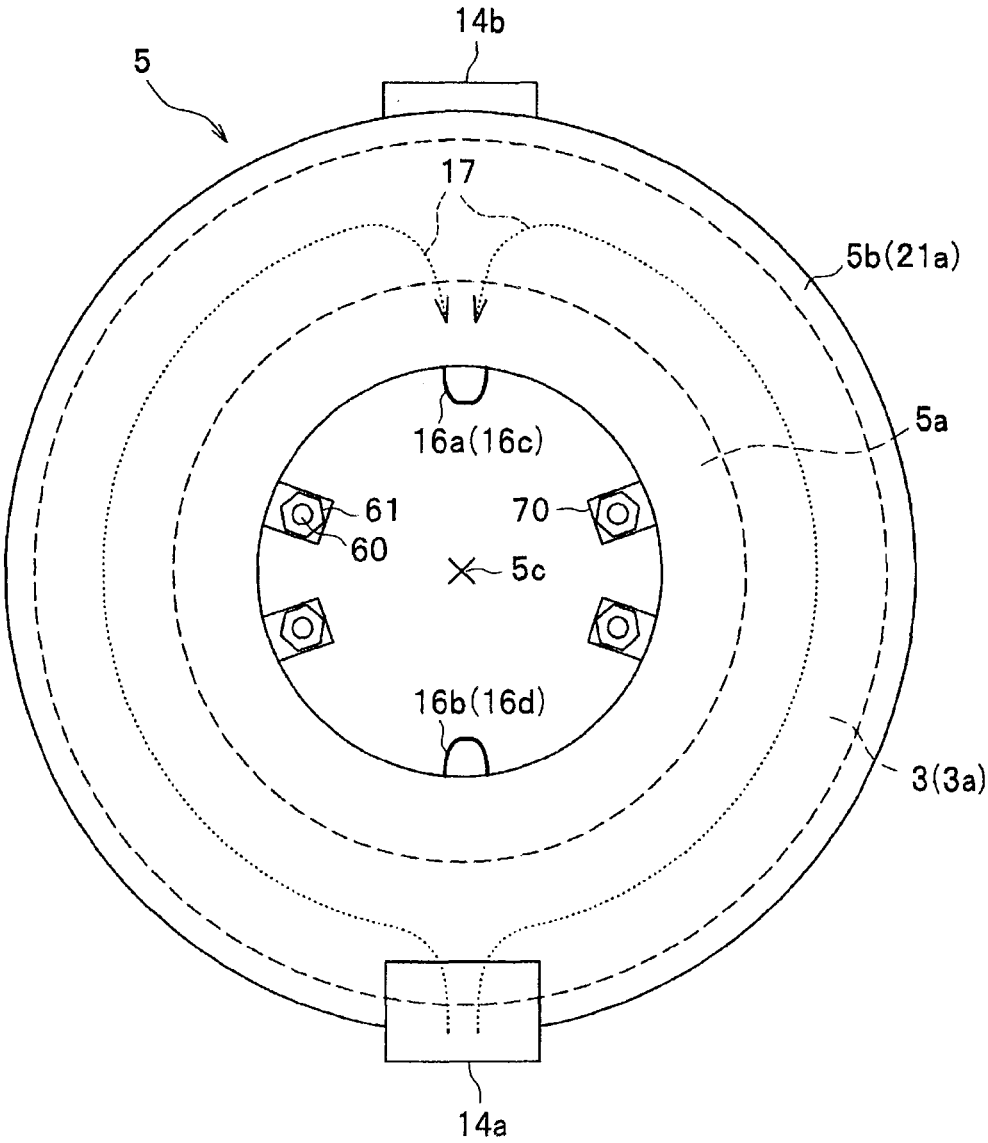
FIG. 8A is a front view of a bobbin for a superconducting coil used in a superconducting magnet apparatus according to a sixth embodiment of the present invention.
Figure 8B:
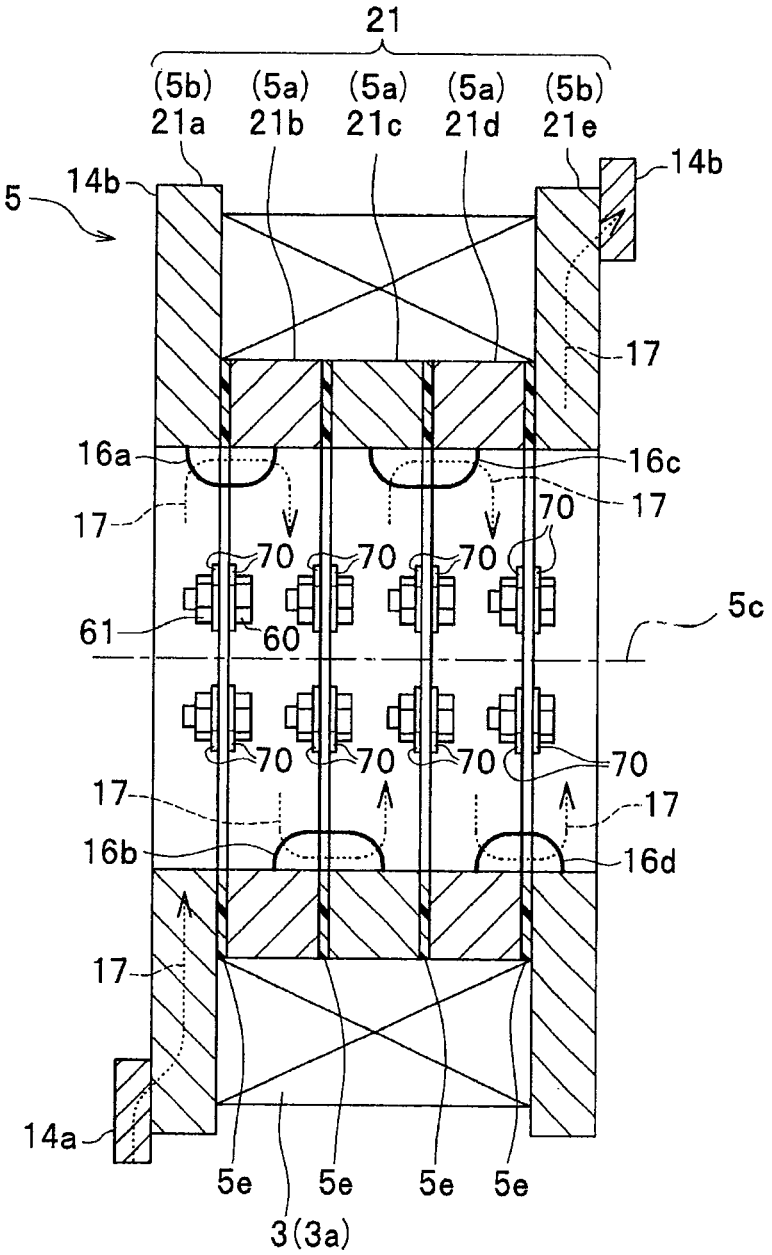
FIG. 8B is a longitudinal sectional view of the superconducting coil and its bobbin used in the superconducting magnet apparatus according to the sixth embodiment of the present invention.

FIG. 8A shows a front view of a bobbin (protective resistor) 5 for a superconducting coil 3 (3*a*) used in a superconducting magnet apparatus according to a sixth embodiment of the present invention, and FIG. 8B shows a longitudinal sectional view of the superconducting coil 3 (3*a*) and its bobbin (protective resistor) 5. The superconducting magnet apparatus according to the sixth embodiment of the present invention differs from those of the first to fifth embodiments in that two connection terminals, 14*a* and 14*b*, are provided on each of one pair of flanges 5*b*. This also allows a current-flow route to be staggered. The bobbin (protective resistor) 5 includes a plurality of partial bobbins 21, namely 21*a*, 21*b*, 21*c*, 21*d*, 21*e*, each formed by dividing the bobbin vertically from a cutting plane perpendicular to a central axis 5*c*. The bobbin also includes insulating sheets 5*e* each provided between any two of the cutting planes each facing one of adjacent partial bobbins 21*a*, 21*b*, 21*c*, 21*d*, 21*e*. The bobbin additionally includes electroconductive connecting portions 16*a*, 16*b*, 16*c*, 16*d* each provided on an inner wall of the bobbin (protective resistor) 5 and electrically connecting any two of the adjacent partial bobbins 21*a*, 21*b*, 21*c*, 21*d*, 21*e*. The two electroconductive connecting portions 16*a*, 16*b*, 16*c*, 16*d* connecting to one partial bobbin 21*b*, 21*c*, 21*d*, face each other across the central axis 5*c*. More specifically, the two electroconductive connecting portions, 16*a* and 16*b*, connecting to the partial bobbin 21*b*, face each other across the central axis 5*c*. Similarly, the two electroconductive connecting portions, 16*b* and 16*c*, connecting to the partial bobbin 21*c*, face each other across the central axis 5*c*. Likewise, the two electroconductive connecting portions, 16*c* and 16*d*, connecting to the partial bobbin 21*d*, face each other across the central axis 5*c*. The electroconductive connecting portions 16*a*, 16*c* and the electroconductive connecting portions 16*b*, 16*d* are each positioned at where a line segment (line) connecting the electroconductive connecting portion 16*a*, 16*c* and the electroconductive connecting portion 16*b*, 16*d* intersects with the central axis 5*c*.

The bobbin (protective resistor) 5 is divided into the plurality of partial bobbins 21, namely 21*a*, 21*b*, 21*c*, 21*d*, 21*e* (in the example of FIG. 8B, five units). In the example of FIG. 8B, the partial bobbing 21*a* and 21*b* correspond to the flange 5*b*, but are not limited to this correspondence relationship. The partial bobbins 21*a* and 21*e* may form part of the flange 5*b* or include part or all of the cylinder 5*a* in addition to the flange 5*b*. In addition, in the example of FIG. 8B, the cylinder 5*a* is divided into three partial bobbins, 21*b*, 21*c*, 21*d*, but not divided only into the three. The cylinder 5*a* may be one partial bobbin, 21*b*, or divided into a plural number other than three.

The cutting planes between the adjacent partial bobbins 21*a*, 21*b*, 21*c*, 21*d*, 21*e* are in close proximity to each other via one insulating sheet 5*e*. A fastening portion 70 is provided on each partial bobbin 21*a*, 21*b*, 21*c*, 21*d*, 21*e*. Any two of the fastening portions 70 on the adjacent partial bobbins 21*a*, 21*b*, 21*c*, 21*d*, 21*e* face each other via one insulating sheet 5*e*, and are securely tightened together by a bolt 60 and a nut 61. This structure with the paired fastening portions 70 tightened together by the bolt 60 and the nut 61 can be the structure described per FIGS. 7A and 7B, that is, the structure with the fastening portions 70*a* and 70*b* tightened together by one bolt 60 and one nut 61. That is to say, it suffices if the phrasing "fastening portions 70*a* and 70*b*" is read to mean the "fastening portions 70". Thus, electrical insulation on the cutting planes between the adjacent partial bobbins 21*a*, 21*b*, 21*c*, 21*d*, 21*e* can be maintained and at the same time, the two opposed adjacent partial bobbins 21*a*, 21*b*, 21*c*, 21*d*, 21*e* can be fastened together.

The adjacent partial bobbins 21*a*, 21*b*, 21*c*, 21*d*, 21*e* are electrically interconnected via the electroconductive connecting portions 16*a*, 16*b*, 16*c*, 16*d*. The electroconductive connecting portions 16*a*, 16*c* are opposed to the electroconductive connecting portions 16*b*, 16*d* across the central axis 5*c*. The current-flow route 17 therefore extends from the connection terminal 14*b* through the partial bobbin 21*a*, the electroconductive connecting portion 16*a*, the partial bobbin 21*b*, the electroconductive connecting portion 16*b*, the partial bobbin 21*c*, the electroconductive connecting portion 16*c*, the partial bobbin 21*d*, the electroconductive connecting portion 16*d*, and the partial bobbin 21*e*, in that order, to the connection terminal 14*b*. In this way, while staggering, the current-flow route 17 is narrowed down and elongated, whereby the resistance value of the bobbin (protective resistor) 5 can be increased. Since the number of partial bobbins 21*a*, 21*b*, 21*c*, 21*d*, 21*e* into which the bobbin is divided is odd (in the example of FIG. 8B, five units), the connection terminals 14*a* and 14*b* are arranged at a rate of one on each side of the central axis 5*c*. If the number of partial bobbins 21*a*, 21*b*, 21*c*, 21*d*, 21*e* into which the bobbin is divided is even, the connection terminals 14*a* and 14*b* are arranged only at one side of the central axis 5*c*. In addition, an electroconductive material to which strength is easy to impart, for example, stainless steel, can be used as the material of the electroconductive connecting portions 16*a*, 16*b*, 16*c*, 16*d*.

Seventh Embodiment

Figure 9A:
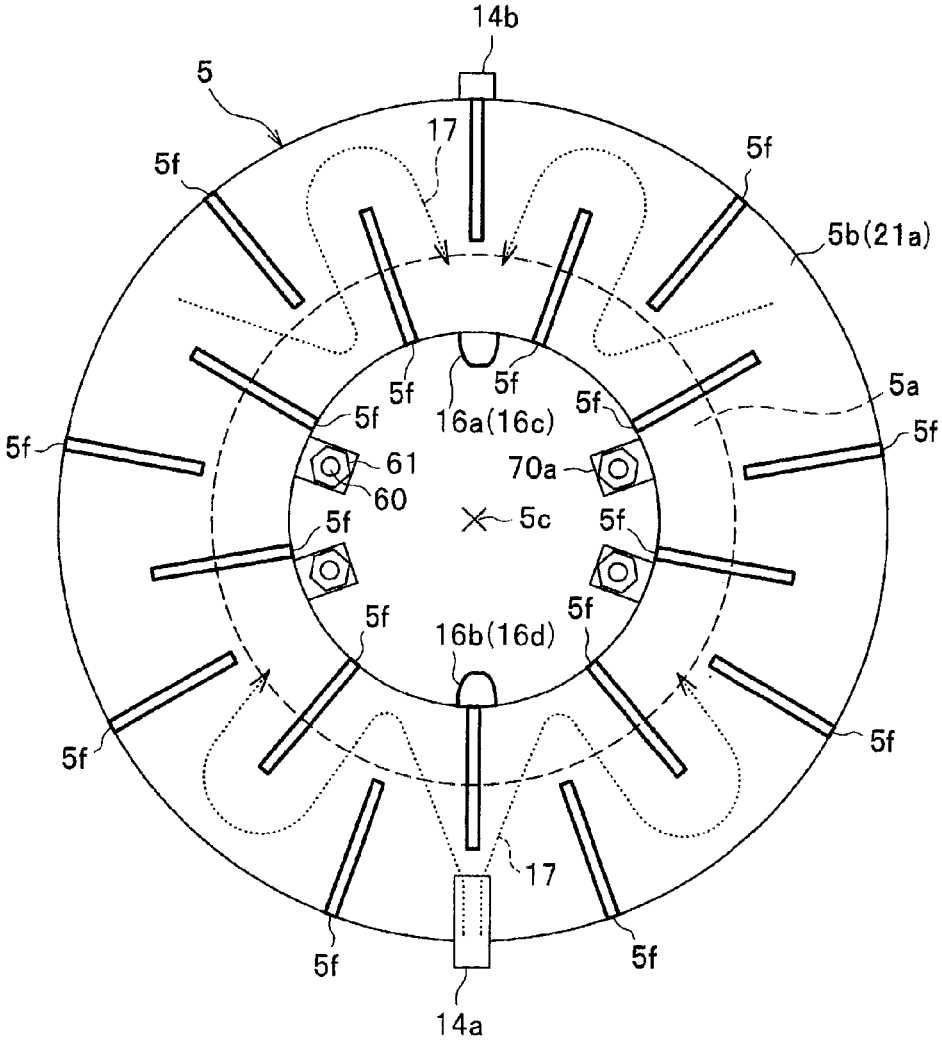
FIG. 9A is a front view of a bobbin for a superconducting coil used in a superconducting magnet apparatus according to a seventh embodiment of the present invention.
Figure 9B:
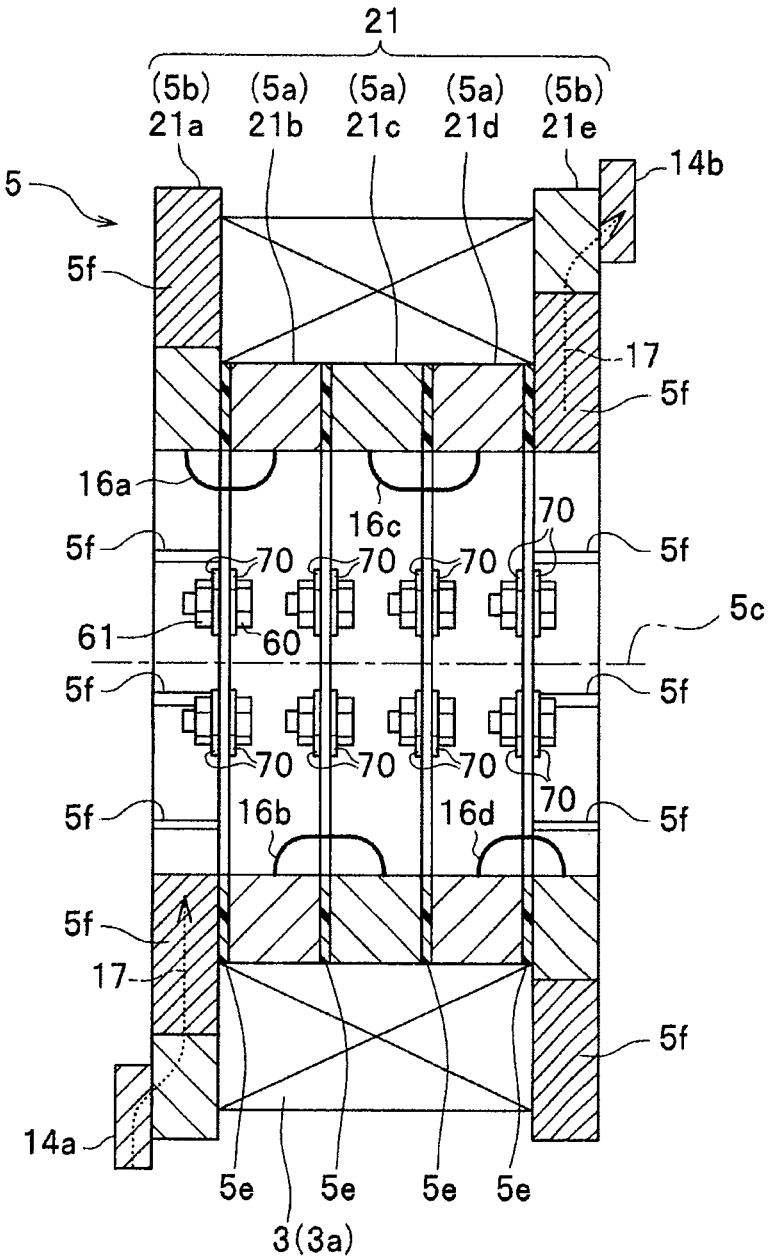
FIG. 9B is a longitudinal sectional view of the superconducting coil and its bobbin used in the superconducting magnet apparatus according to the seventh embodiment of the present invention.

FIG. 9A shows a front view of a bobbin (protective resistor) 5 for a superconducting coil 3 (3*a*) used in a superconducting magnet apparatus according to a seventh embodiment of the present invention, and FIG. 9B shows a longitudinal sectional view of the superconducting coil 3 (3*a*) and its bobbin (protective resistor) 5. In the superconducting magnet apparatus according to the seventh embodiment, the grooves 5*f* in the fifth embodiment and the partial bobbins 21*a*, 21*b*, 21*c*, 21*d*, 21*e*, etc. in the sixth embodiment are combined to form a longer current-flow route 17 for further increased resistance value of the bobbin (protective resistor) 5. The grooves 5*f* are formed on both of one pair of flanges 5*b* (partial bobbins 21*a* and 21*e*). The grooves 5*f* on the partial bobbin 21*e* have a layout pattern matching that obtained by rotating a layout pattern of the grooves 5*f* of the partial bobbin 21*a* through 180 degrees about a central axis 5*c*. Thus in the partial bobbin 21*a*, the current-flow route 17 starts from a connection terminal 14*a*, detours the grooves 5*f* on the partial bobbin 21*a*, and reaches an electroconductive connecting portion 16*a*. In the partial bobbin 21*e*, the current-flow route 17 starts from an electroconductive connecting portion 16*d*, staggers along an upper surface of the partial bobbin 21*e* while detouring the grooves 5*f* present thereon, and reaches a connection terminal 14*b*. In addition, the current-flow route 17 from the electroconductive connecting portion 16*a* to the electroconductive connecting portion 16*d* extends from the electroconductive connecting portion 16*a*, through the partial bobbin 21*b*, an electroconductive connecting portion 16*b*, the partial bobbin 21*c*, an electroconductive connecting portion 16*c*, and the partial bobbin 21*d*, in that order, to the electroconductive connecting portion 16*d*. In this way, while staggering, the current-flow route 17 is elongated, whereby the resistance value of the bobbin (protective resistor) 5 can be increased.

The present invention is not limited to the above-described first to seventh embodiments and may include various modifications. For example, the first to seventh embodiments have been described in detail only for clarity of the present invention and are not limited to apparatus configurations including all described constituent elements. In addition, part of the configurations in the first to seventh embodiments may be replaced by any one or more of the other embodiments, and conversely, any one or more of the other embodiments may be added to part of the configurations in the first to seventh embodiments. Furthermore, addition, deletion, and/or replacement of any one or more of the other embodiments may take place for part of the configurations in the first to seventh embodiments.

What is claimed is:

1. A superconducting magnet apparatus comprising:
- a bobbin around which a superconducting coil is wound, the bobbin serving as a protective resistor;
- a persistent current switch for supplying a persistent current to the superconducting coil;
- a first closed circuit with the superconducting coil and the persistent current switch connected to each other in series; and
- a second closed circuit with the superconducting coil and the bobbin connected to each other in series.

2. The superconducting magnet apparatus according to claim 1, further comprising:
- a fuse formed so that upon normal electrical conduction occurring in the superconducting coil, the fuse transitions from a superconducting state into a normal conducting state and blows out,
- wherein, in the first closed circuit, the superconducting coil, the persistent current switch, and the fuse are interconnected in series.

3. The superconducting magnet apparatus according to claim 1, in the second closed circuit, the superconducting coil, the bobbin, and the persistent current switch are interconnected in series.

4. The superconducting magnet apparatus according to claim 1, adapted to further include a third closed circuit in which the persistent current switch, an excitation power supply, and a circuit breaker are interconnected in series.

5. The superconducting magnet apparatus according to claim 4, wherein, in the third closed circuit, the persistent current switch, the fuse, the excitation power supply, and the circuit breaker are interconnected in series.

6. The superconducting magnet apparatus according to claim 2, further comprising:

a quench detector that detects the normal conducting state occurring in the superconducting coil;

a heater that comes into contact with the fuse;

a heat insulator shrouding the fuse and the heater; and a current source formed to supply a current to the heater upon detection of the normal conducting state occurring in the superconducting coil;

wherein the fuse, upon the current being supplied to the heater, transitions into the normal conducting state and blows out by generating joule heat in the fuse itself.

7. The superconducting magnet apparatus according to claim 1, wherein the bobbin includes:

a cylinder; and one pair of flanges provided at opposite ends of the cylinder, with an inside diameter of the flanges being equal to that of the cylinder and an outside diameter of the flanges being greater than that of the cylinder; and wherein wiring of the second closed circuit is connected to two places on the flanges, across a central axis of the bobbin.

8. The superconducting magnet apparatus according to claim 7, wherein:

the cylinder and the flanges are electrically insulated from each other; and grooves are formed on the flanges.

9. The superconducting magnet apparatus according to claim 8, wherein the bobbin includes:

a plurality of partial bobbins, each formed by dividing the bobbin vertically from a cutting plane perpendicular to a central axis of the bobbin;

insulating sheets, each provided between any two of the cutting planes each facing one adjacent partial bobbin of the partial bobbins; and electroconductive connecting portions, each provided on an inner wall of the bobbin and electrically connecting any two adjacent partial bobbins of the partial bobbins; and wherein the two electroconductive connecting portions connecting to one of the partial bobbins face each other across the central axis of the bobbin.

10. The superconducting magnet apparatus according to claim 2, wherein the superconducting coil, the persistent current switch, and the fuse are constructed using a high-temperature superconducting wire having a critical temperature exceeding 18 K.

11. The superconducting magnet apparatus according to claim 2, wherein, compared with cryogenic stabilizers disposed around superconductors of superconducting filaments used in the superconducting coil and the persistent current switch, a cryogenic stabilizer disposed around a superconductor of a superconducting filament used in the fuse has high electrical resistivity and low thermal conductivity.

12. The superconducting magnet apparatus according to claim 1, further comprising:

a heat transfer element included in a vacuum vessel; and a refrigerator thermally connecting to the heat transfer element, for cooling the heat transfer element, wherein the heat transfer element thermally connects to the superconducting coil and the persistent current switch.

13. The superconducting magnet apparatus according to claim 2, in the second closed circuit, the superconducting coil, the bobbin, and the persistent current switch are interconnected in series.

14. The superconducting magnet apparatus according to claim 2, wherein the bobbin includes:

a plurality of partial bobbins, each formed by dividing the bobbin vertically from a cutting plane perpendicular to a central axis of the bobbin;

insulating sheets, each provided between any two of the cutting planes each facing one adjacent partial bobbin of the partial bobbins; and electroconductive connecting portions, each provided on an inner wall of the bobbin and electrically connecting any two adjacent partial bobbins of the partial bobbins; and wherein the two electroconductive connecting portions connecting to one of the partial bobbins face each other across the central axis of the bobbin.

15. The superconducting magnet apparatus according to claim 3, wherein the bobbin includes:

a plurality of partial bobbins, each formed by dividing the bobbin vertically from a cutting plane perpendicular to a central axis of the bobbin;

insulating sheets, each provided between any two of the cutting planes each facing one adjacent partial bobbin of the partial bobbins; and electroconductive connecting portions, each provided on an inner wall of the bobbin and electrically connecting any two adjacent partial bobbins of the partial bobbins; and wherein the two electroconductive connecting portions connecting to one of the partial bobbins face each other across the central axis of the bobbin.

16. The superconducting magnet apparatus according to claim 4, wherein the bobbin includes:

a plurality of partial bobbins, each formed by dividing the bobbin vertically from a cutting plane perpendicular to a central axis of the bobbin;

insulating sheets, each provided between any two of the cutting planes each facing one adjacent partial bobbin of the partial bobbins; and electroconductive connecting portions, each provided on an inner wall of the bobbin and electrically connecting any two adjacent partial bobbins of the partial bobbins; and wherein the two electroconductive connecting portions connecting to one of the partial bobbins face each other across the central axis of the bobbin.

17. The superconducting magnet apparatus according to claim 5, wherein the bobbin includes:

a plurality of partial bobbins, each formed by dividing the bobbin vertically from a cutting plane perpendicular to a central axis of the bobbin;

insulating sheets, each provided between any two of the cutting planes each facing one adjacent partial bobbin of the partial bobbins; and electroconductive connecting portions, each provided on an inner wall of the bobbin and electrically connecting any two adjacent partial bobbins of the partial bobbins; and wherein the two electroconductive connecting portions connecting to one of the partial bobbins face each other across the central axis of the bobbin.

18. The superconducting magnet apparatus according to claim 6, wherein the bobbin includes:

a plurality of partial bobbins, each formed by dividing the bobbin vertically from a cutting plane perpendicular to a central axis of the bobbin;

insulating sheets, each provided between any two of the cutting planes each facing one adjacent partial bobbin of the partial bobbins; and electroconductive connecting portions, each provided on an inner wall of the bobbin and electrically connecting any two adjacent partial bobbins of the partial bobbins; and wherein the two electroconductive connecting portions connecting to one of the partial bobbins face each other across the central axis of the bobbin.

19. The superconducting magnet apparatus according to claim 7, wherein the bobbin includes:

a plurality of partial bobbins, each formed by dividing the bobbin vertically from a cutting plane perpendicular to a central axis of the bobbin;

insulating sheets, each provided between any two of the cutting planes each facing one adjacent partial bobbin of the partial bobbins; and electroconductive connecting portions, each provided on an inner wall of the bobbin and electrically connecting any two adjacent partial bobbins of the partial bobbins; and wherein the two electroconductive connecting portions connecting to one of the partial bobbins face each other across the central axis of the bobbin.

20. The superconducting magnet apparatus according to claim 8, wherein the bobbin includes:

a plurality of partial bobbins, each formed by dividing the bobbin vertically from a cutting plane perpendicular to a central axis of the bobbin;

insulating sheets, each provided between any two of the cutting planes each facing one adjacent partial bobbin of the partial bobbins; and electroconductive connecting portions, each provided on an inner wall of the bobbin and electrically connecting any two adjacent partial bobbins of the partial bobbins; and wherein the two electroconductive connecting portions connecting to one of the partial bobbins face each other across the central axis of the bobbin.

* * * * *